US005745954A

United States Patent [19]

Shogan et al.

[11] Patent Number: 5,745,954

[45] Date of Patent: May 5, 1998

[54] PLAYYARD HINGE

[75] Inventors: Gregory P. Shogan, Apex, N.C.; David J. Stroud, Dayton; Mark Dawley, Beavercreek, both of Ohio

[73] Assignee: Lisco, Inc., Tampa, Fla.

[21] Appl. No.: 736,742

[22] Filed: Oct. 25, 1996

[51] Int. Cl.[6] ..... E05D 11/10

[52] U.S. Cl. ..... 16/343; 16/326; 5/99.1; 403/102

[58] Field of Search ..... 16/343, 342, 344, 16/345, 346, 325, 326, 335, 336; 5/99.1, 98.1, 98.3, 93.2, 111, 114; 403/100, 101, 102, 218

[56] References Cited

U.S. PATENT DOCUMENTS

| | | | |
|---|---|---|---|
| 4,611,945 | 9/1986 | Diego | 403/102 |
| 4,811,437 | 3/1989 | Dillner et al. | 5/99.1 |
| 5,293,656 | 3/1994 | Chan | 16/326 |
| 5,353,451 | 10/1994 | Hsiung | 5/99.1 |
| 5,483,710 | 1/1996 | Chan | 16/326 |
| 5,530,977 | 7/1996 | Wang | 16/326 |

*Primary Examiner*—Chuck Mah

[57] ABSTRACT

A hinge positioned at the intermediate extents of the adjacent rail components to hold such components in an aligned orientation including a saddle with a central button aperture, interior plate apertures and exterior end apertures with associated rail pins for pivotally coupling the saddle and the adjacent interior ends of associated rail components, a pair of locking plates each with a plate pin coupling the upper end of each plate to a plate aperture of the saddle, each plate having an opening extending therethrough the plates urged away from each other, a liftable button with an elongated slot and with an associated button pin for slidably coupling the button to the saddle, the button having inclined bearing surfaces on their edges and an inwardly facing projection located at the adjacent interior edge of each adjacent rod segment, each projection having an upper curved surface and a lower planar surface receivable by the bearing opening.

5 Claims, 5 Drawing Sheets

PLAYYARD HINGE

BACKGROUND OF THE INVENTION

1. Field of the Invention

The present invention relates to a hinge and, more particularly, to a playyard having a hinge adapted to safely and conveniently convert the playyard between a deployed orientation and a collapsed orientation.

2. Description of the Prior Art

The use of playyards for receiving and supporting children is well known. Further, playyards with foldable capabilities are also well known. Such foldable playyards typically have hinges for converting the playyard between an erect deployed orientation and a collapsed orientation for transportation and storage.

One key element to allow playyards to be retained in one orientation or another are hinges. Such hinges, however, must be made safe for the child and convenient for the health care provider. All known hinges suffer from one defect or the other.

The patent literature discloses various playyards with hinge capabilities. Note, for example. U.S. Pat. Nos. 5,293,656 and 5,483,710, both to Chan as well as U.S. Pat. No. 4,811,437 to Dilner.

None of these playyards with their hinges, however, provides the safety and convenience attended with the present invention, the playyard with the new and improved hinge.

The present invention achieves its intended purposes, objects and advantages over the prior art through a new, useful and unobvious combination of components elements, through the use of a minimum number of functioning parts, at a reasonable cost to manufacture, and through the utilization of only readily available and conventional materials.

Therefore, the present invention relates to a new and improved hinge positioned at the intermediate extents of the adjacent rail components to hold such components in an aligned orientation including: a saddle with a central button aperture, interior plate apertures and exterior end apertures with associated rail pins for pivotally coupling the saddle and the adjacent interior ends of associated rail components; a pair of locking plates each with a plate pin coupling the upper end of each plate to a plate aperture of the saddle, each plate having an opening extending therethrough the plates urged away from each other; a liftable button with an elongated slot and with an associated button pin for slidably coupling the button to the saddle, the saddle having inclined bearing surfaces on their edges and an inwardly facing projection located at the adjacent interior edge of each adjacent rod segment, each projection having an upper curved surface and a lower planar surface receivable by the bearing opening.

Therefore, it is an object of this invention to provide a playyard hinge which overcomes the aforementioned inadequacies of the prior art devices and which constitutes an improvement which is a significant contribution to the advancement of the art.

Another object of the invention to provide for the convenient deployment and collapse of a playyard with maximum safety.

It is another object of the present invention to maximize the safety of a playyard hinge which may be easily and efficiently manufactured and marketed.

It is further object of the present invention to provide a playyard hinge construction which is of a durable and reliable construction.

The foregoing has outlined some of the more pertinent objects of the present invention. These objects should be construed to be merely illustrative of some of the more prominent features and applications of the intended invention. Many other beneficial results could be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention as defined by the claims taken in conjunction with the accompanying drawings.

SUMMARY OF THE INVENTION

The invention is defined by the appended claims with the specific embodiment shown on the attached drawings. For the purposes of summarizing the invention, the invention essentially comprises a playyard hinge.

The present invention includes a playyard of the type having a frame with an upper rail assembly positionable in a horizontal orientation when in a deployed orientation and formed of two side rails and two end rails with each of the rails being formed of two rail components having interior ends and exterior ends, the interior ends being pivotally coupled with respect to each other for movement between the deployed orientation wherein the rails are horizontally disposed in a common plane and a collapsed orientation wherein the rails are vertically disposed and parallel, the frame also including a lower rail assembly positionable in a horizontal orientation beneath the upper rail assembly when in a deployed orientation, the frame also including four vertically extending corner rails pivotally coupling the upper rail assembly and the lower rail assembly, the playyard also having fabric components above the lower frame assembly and between the corner rails: a hinge positioned at the intermediate extents of the end rails and side rails to allow movement of the associated rail components between the horizontal orientation and each hinge including: a saddle in a generally inverted U-shaped configuration with a central button aperture, interior plate apertures and exterior end apertures with associated rail pins for pivotally coupling the saddle and the adjacent interior ends of associated rail components; a pair of normally vertically-oriented locking plates each with a plate pin coupling the upper end of each plate to a plate aperture of the saddle, each plate having an opening extending therethrough with a lower bearing surface and with springs urging the plates away from each other to a vertical orientation; a liftable button with a vertically-oriented elongated slot through a central extent thereof and with an associated button pin for slidably coupling the button to the saddle, the saddle having inclined bearing surfaces on their upper exterior edges; and an inwardly facing projection located at the adjacent interior edge of each adjacent rod segment, each projection having an upper surface and a lower planar surface with a notch whereby the notches are receivable with the bearing surfaces of the plates when the rod segments are in axial alignment to thereby provide a supplemental force to maintain the playyard deployed and wherein upward movement of the button will allow movement of the inclined surfaces against the lower edges of the plates to urge the plates inwardly toward each other and thereby allow separation of the notches from the plates and subsequent movement of the playyard to the collapsed orientation.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. Its should be appreciated by those skilled in the art that the conception and the disclosed specific embodiment may be readily utilized as a basis for modifying or designing other structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

The same reference numerals refer to the same parts through the various Figures.

DESCRIPTION OF THE PREFERRED EMBODIMENT

The present invention relates to a playyard with a improved hinge construction. In its broadest context, the present invention includes a frame structure to which fabric panels are secured. In addition, the upper rail assemblies each are composed of rail sections having interior ends safely but readily movable between a deployed and collapsed orientation.

Figure 1:
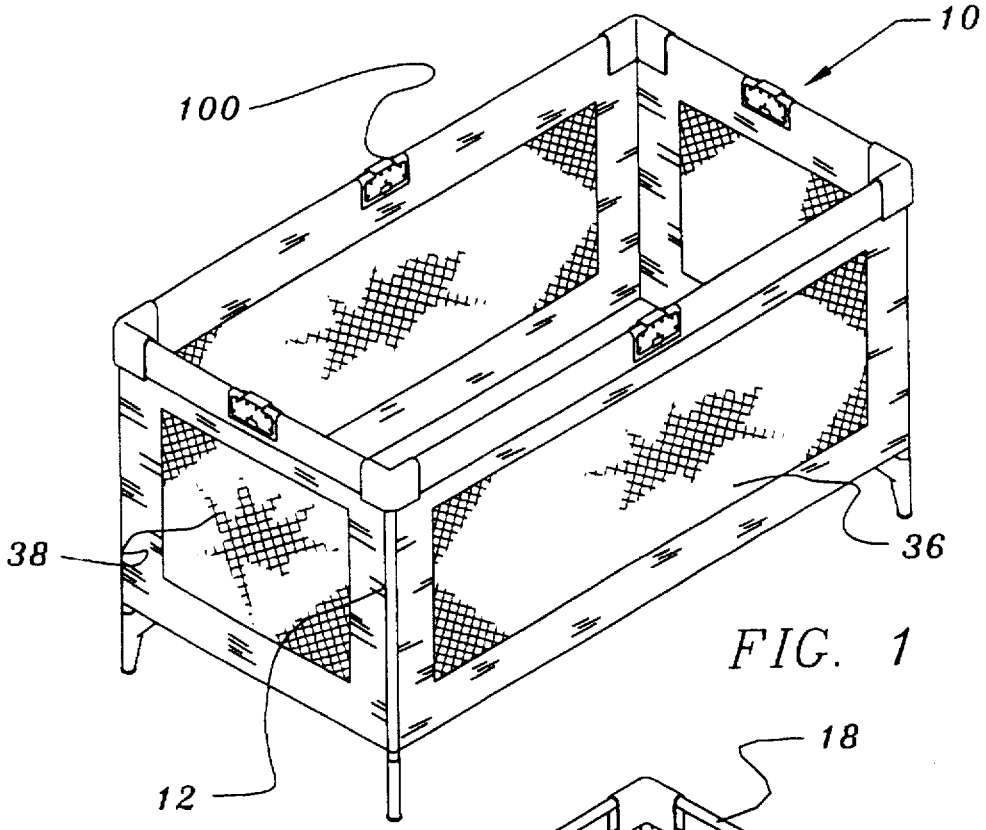
FIG. 1 is a perspective illustration of a playyard constructed in accordance with the principles of the present invention.
Figure 2:
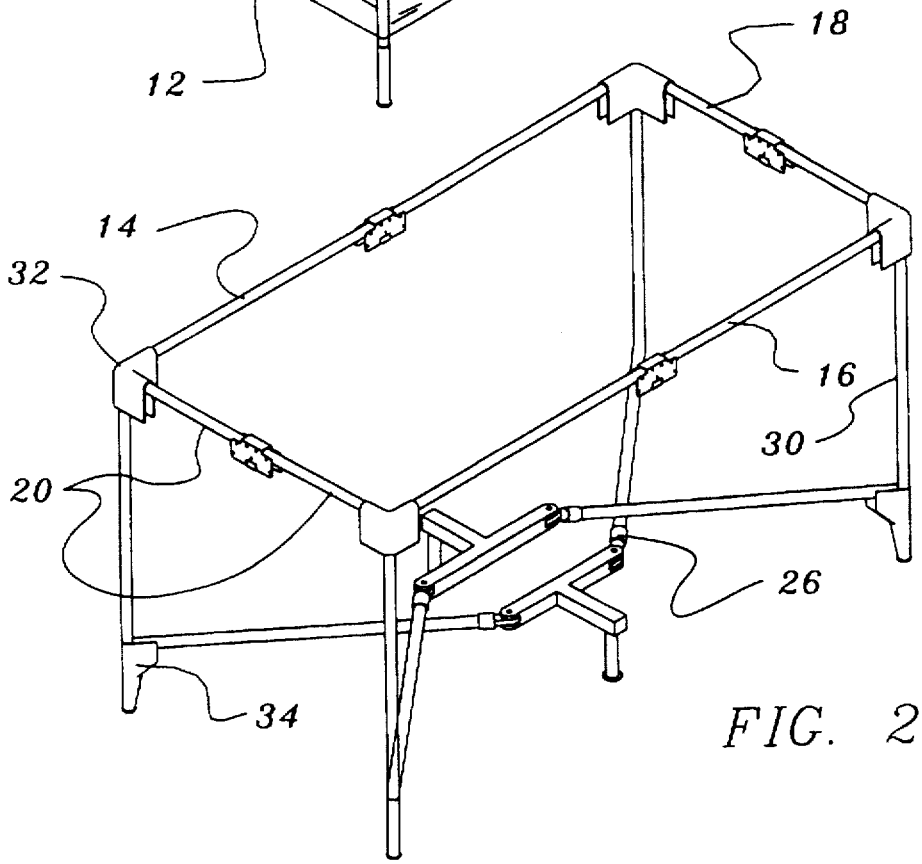
FIG. 2 is a perspective showing similar to FIG. 1 but with the fabric enclosure removed to show the frame only.
Figure 3:
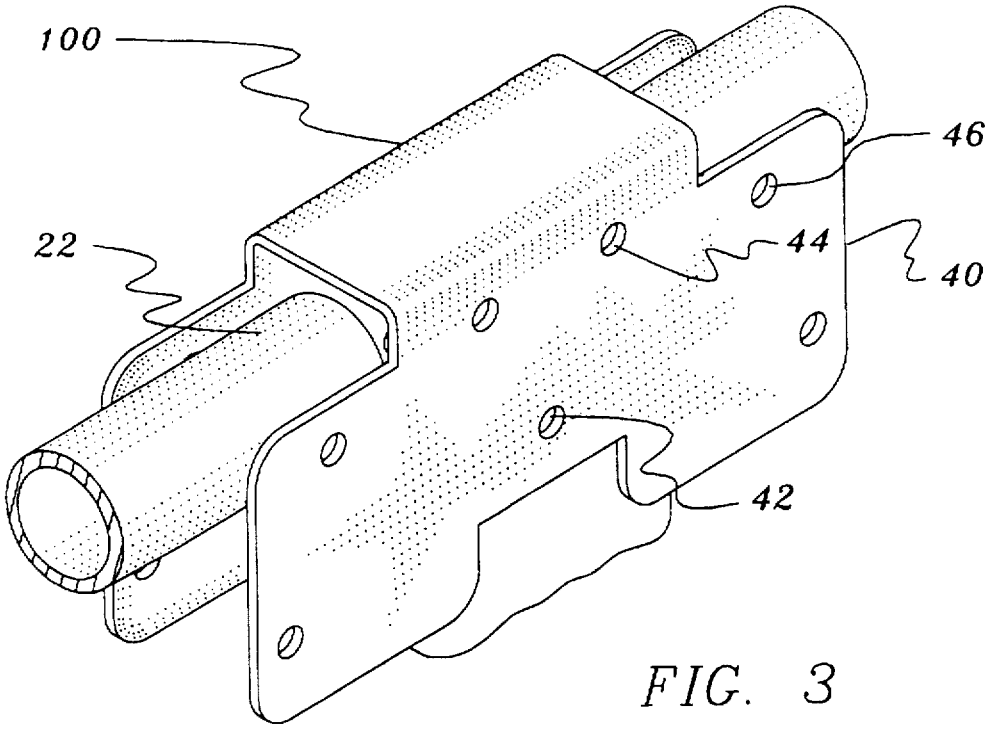
FIG. 3 is an enlarged perspective illustration of the hinge assembly shown in the prior figures.

More specifically, the present invention is a playyard 10. It is of a type having a supporting frame 12. The frame has an upper rectangular rail assembly 14. Such rail assembly is positionable in a horizontal orientation as shown in FIGS. 1 and 2. Such orientation is for when the playyard is in a operative or deployed orientation. The frame assembly, rectangular in the primary embodiment, is provided with two longer side rails 16 and two shorter end rails 18. The rails, in an alternate embodiment, are all of equal length to form a square playyard. Each of the rails, whether the side rails or the end rails, is formed to include two rail components 20. Each rail component has a interior end 22 and an exterior end 24.

Figure 5:
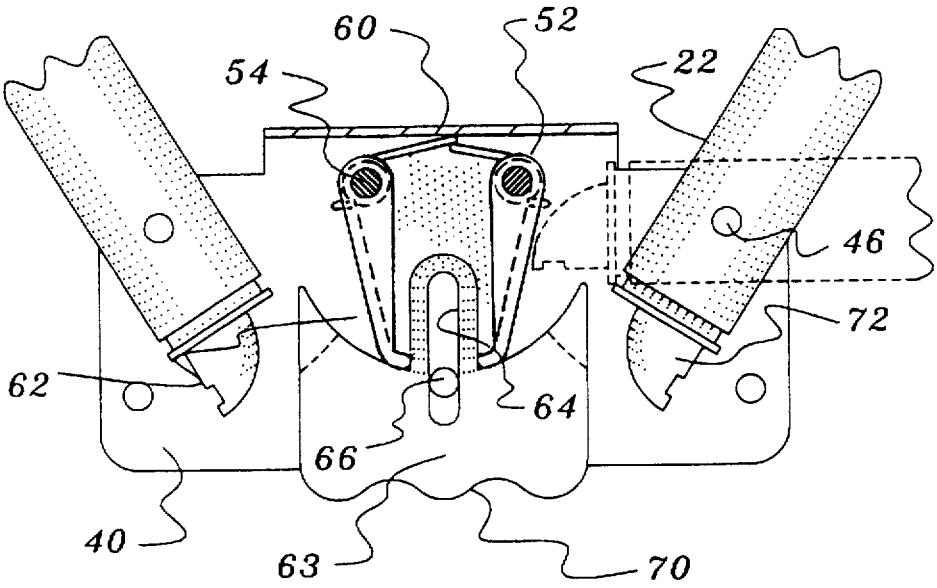
FIG. 5 is a view similar to FIG. 4 but illustrating the hinge in the collapsed orientation.
Figure 6:
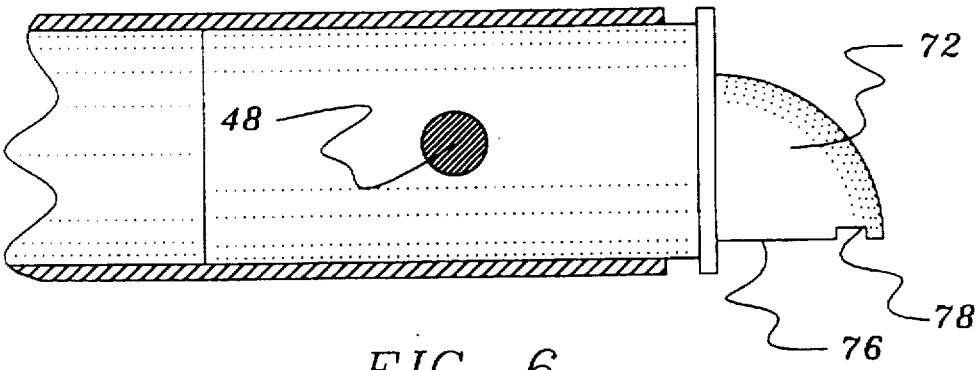
FIG. 6 is a cross-section view of one of the interior ends of an end rail shown in FIGS. 4 and 5.
Figure 7:
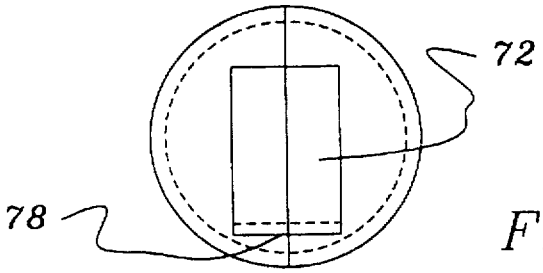
FIG. 7 is an end elevational view of the rail section shown in FIG. 6.
Figure 8:
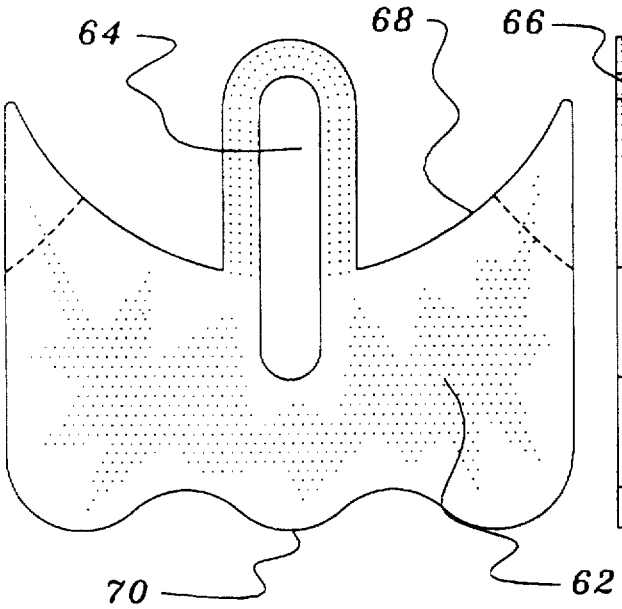
FIGS. 8 and 9 are enlarged side and end elevational views of the button shown in FIGS. 4 and 5.
Figure 9:
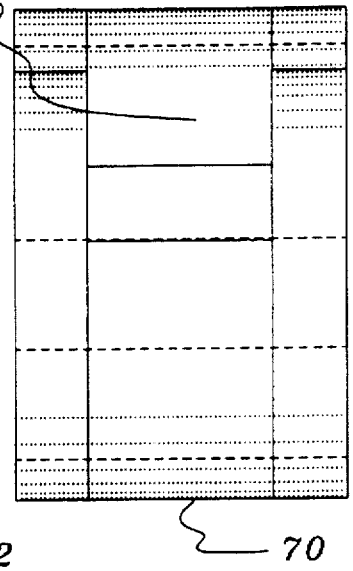
Figure 10:
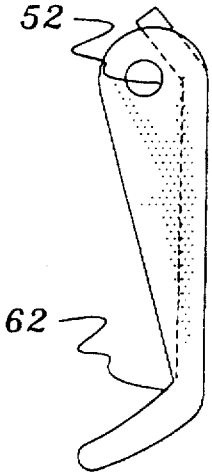
FIGS. 10 and 11 are enlarged end side elevational views of a hinge plate shown in FIGS. 4 and 5.
Figure 11:
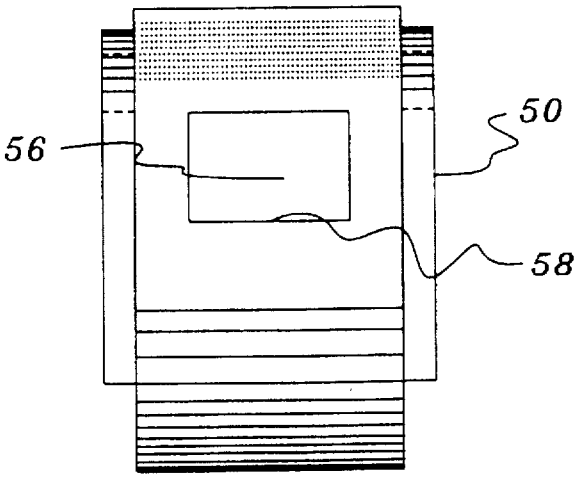
Figure 12:
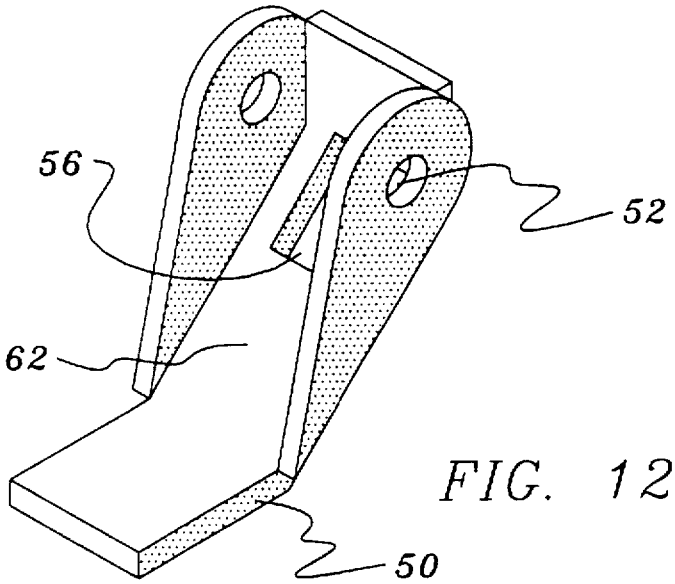
FIG. 12 is a perspective illustration of the locking plate shown in FIGS. 10 and 11.
Figure 13:
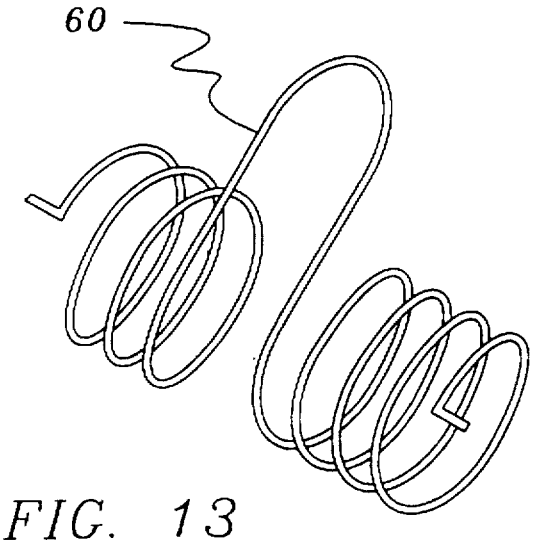
FIG. 13 is a perspective illustration of tone of the springs for biassing the locking plates to the position of FIG. 5.

The interior ends of the rails are pivotally coupled with respect to each other through a hinge assembly to be 100 later described. Such hinge of the hinge assemblies allow movement between the deployed orientation as shown in FIG. 1 wherein the rails are horizontally disposed in a common plane with the rail components being in axial alignment one with respect to another and a collapsed orientation wherein the rails are all essentially disposed vertically and parallel with respect to each other. Note FIG. 5.

The frame also includes a lower rail assembly 26. The lower rail assembly 28 is positionable in a horizontal orientation. Note FIG. 2. Such orientation is at a location beneath the upper rail assembly when it is deployed.

The frame also includes four vertically extending corner rails 30. Such rails are pivotally coupled at their upper ends through fixed upper corner brackets 32 to their upper rail assemblies and at their lower ends through fixed lower corner brackets or feet 34 to the lower rail assemblies. Upper corner brackets and lower corner brackets affect the coupling of the vertical rails to the upper and lower rail assemblies in the conventional manner. Further details of the lower rail assembly may be had by reference to U.S. Pat. No. 5,381,570 to Top Fortune. The subject matter of such patent is incorporated herein by reference.

Also provided as a major component of the playyard 10 are fabric components. Such fabric components include a lower panel 36 positioned above the lower rail assembly. Also included as part of the component assembly are side panels 38. Such side panels are located between the upper and lower rail assemblies and between the vertical corner rails.

The unique feature of the present invention is principally in the hinge 100. There are preferably four similarly configured hinges, one positioned at the intermediate extents of the end rails and the side rails which are at the adjacent interior ends of the associated rail components. The function of the hinge is to allow safe and convenient movement of the associated rail components between a horizontal orientation and the collapsed position. Each hinge includes as its major component a saddle 40. The saddle is a rigid member in a generally inverted U-shaped configuration. Each hinge is provided with a central button aperture 42 as well as interior plate apertures 44 and exterior rail apertures 46. The rail apertures are provided with rail pins 48. The rail pins extend through associated apertures in the adjacent ends of the rail components for pivotally coupling the saddle and the adjacent interior ends of the associated rail components.

Figure 4:
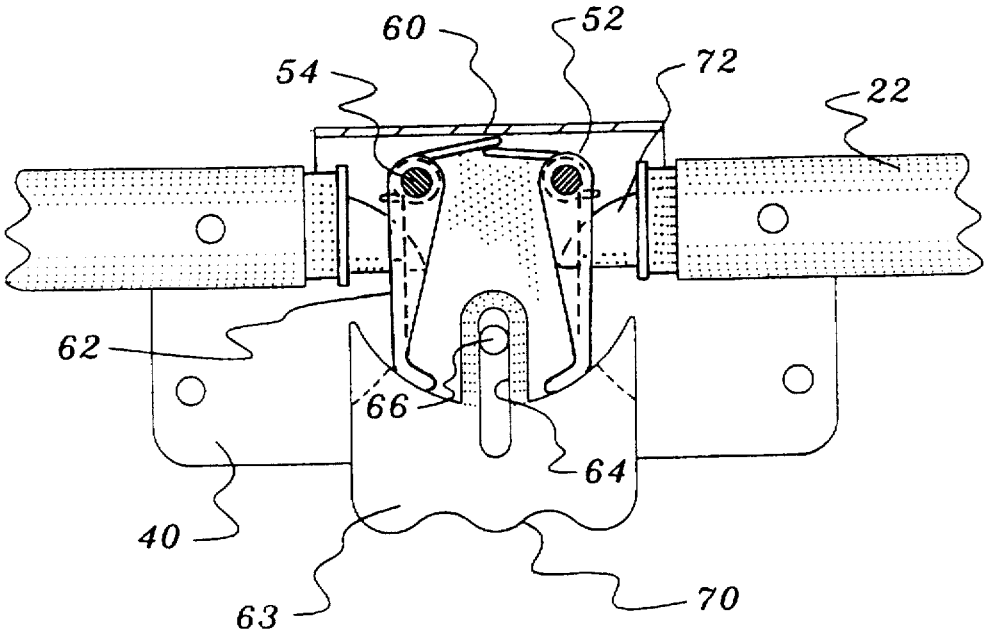
FIG. 4 is a side elevational view, partly in cross-section of the hinge shown in FIG. 3.

A pair of normally vertically oriented locking plates 50 are also coupled to the saddles. Each locking plate includes a curved upper portion with a central aperture 52 and a plate pin 54 coupling the upper end of each plate to a plate aperture of the saddle. Each plate is also formed with an enlarged opening 56. The opening extends therethrough and is adapted to cooperate with the rail components as will be later described. Each opening has a lower bearing surface 58. In addition, springs, preferably coil springs 60, one for each locking plate, are located around the plate pins 54 with their central extents in contact with the upper horizontal portion of the saddle at their upper axially exterior ends and in contact with the lateral extents of the plates at their lower central extents. This tends to urge the plates away from each other toward a vertical orientation as shown in FIG. 4 for locking purposes.

Movement of the plates when changing orientation of the rails is achieved through a liftable button 62. Each such liftable button, one for each saddle and hinge, has a slot 64 through a centrally extent thereof. The slot is vertically oriented with a button pin 66 extending therethrough and coupled to the lock apertures of the saddle. This will allow for the sliding upwardly of the button with respect to the saddle. The button is also formed to have inclined bearing surfaces 68. Such bearing surfaces are at the upper exterior edges of the button and are adapted, when the button is lifted, to contact the lower inturned ends of the plates and move them toward each other when removing the coupling effect between the rail components achieved by the locking plates. The lower surface 70 of the button is adapted to be contacted by a user and squeezed upwardly against the upper extent of the saddle when orienting the hinge to the collapsed orientation. Such lower surface 70 is formed with undulations 63 for receiving a users fingers.

Located within apertures of each rail is an inwardly facing projection 72. Such projections are located at the interior edge 74 of each rod segment. Each projection has an upper surface adapted to contact the lower edge of the locking plates and push them inwardly when moving toward the deployed orientation. Each projection has a lower planar surface 76. The lower planar surface is provided with a notch 78. Such notches are adapted to receive the bearing surfaces of the plate when the rod segments are in axial alignment at the deployed orientation. Such an arrangement of the notch coupled with respect to the bearing surface functions to maintain the playyard deployed. Further, upward movement of the button will have its inclined bearing surfaces contact the lower edges of the plates to move the plates inwardly. When coupled by an overall movement of the hinge upwardly to move the notches from the bearing surface will allow the collapsing of the rails to the collapsed orientation of the playyard.

It has been found that when the playyard is in the open deployed orientation for use, the entire frame, including the regions of the central hinges on the upper frame assembly, are in a high force condition of tension/compression due to the orientation of the rails, locking plates, hinges, corner brackets, etc. Lifting of the buttons to collapse the frame is virtually impossible by forces which might be extended by a child within the playyard or a care provider outside of the playyard. When, however, the hinges of the lower frame assembly are lifted to bend the central extent of the rails of the lower frame assembly, then the forces acting on the central hinges of the upper rail assembly are relieved and the buttons can then be lifted to allow the collapsing of the upper rail assembly and the playyard. The projections extending through the apertures of the locking plates provide the locking forces to maintain the playyard safely deployed. In addition, the notches in the projections and the associated bearing surfaces in the locking plates constitute a supplemental and redundant safety feature to further preclude inadvertent collapsing the playyard.

As can be seen from the foregoing, a simple lifting of the hinge by lifting the saddle upwardly from the collapsed orientation will automatically allow the projections to enter the openings of the plates and for the notches of the projections to receive the bearing surfaces in the openings of the plates. Conversely, the squeezing of the central extent of the hinge will cause the button to move upwardly and have its inclined bearing surfaces move the lower ends of the plates inwardly against the action of the spring. When coupled with a slight vertical upward and downward movement of the saddle will separate the notches from the bearing surfaces of the plates to allow the movement of the hinge downwardly and the playyard to the collapsed orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In a playyard of the type having a frame with an upper rail assembly positionable in a horizontal orientation when in a deployed orientation and formed of two side rails and two end rails with each of the rails being formed of two rail components having interior ends and exterior ends, the interior ends being pivotally coupled with respect to each other for movement between the deployed orientation wherein the rails are horizontally disposed in a common plane and a collapsed orientation wherein the rails are vertically disposed and parallel, the frame also including a lower rail assembly positionable in a horizontal orientation beneath the upper rail assembly when in a deployed orientation, the frame also including four vertically extending corner rails pivotally coupling the upper rail assembly and the lower rail assembly, the playyard also having fabric components above the lower frame assembly and between the corner rails:

a hinge positioned at the intermediate extents of the end rails and side rails to allow movement of the associated rail components between the horizontal orientation and each hinge including:

a saddle in a generally inverted U-shaped configuration with a central button aperture, interior plate apertures and exterior end apertures with associated rail pins for pivotally coupling the saddle and the adjacent interior ends of associated rail components;

a pair of normally vertically-oriented locking plates each with a plate pin coupling the upper end of each plate to a plate aperture of the saddle, each plate having an opening extending therethrough with a lower bearing surface and with springs urging the plates away from each other to a vertical orientation;

a liftable button with a vertically-oriented elongated slot through a central extent thereof and with an associated button pin for slidably coupling the button to the saddle, the saddle having inclined bearing surfaces on their upper exterior edges; and an inwardly facing projection located on the interior end of each rail component, each projection having an upper surface and a lower planar surface with a notch whereby the notches are receivable with the bearing surfaces of the plates when the rail components are in axial alignment to thereby provide a supplemental force to maintain the playyard deployed and wherein upward movement of the button will allow movement of the inclined surfaces against the lower edges of the plates to urge the plates inwardly toward each other and thereby allow separation of the notches from the plates and subsequent movement of the playyard to the collapsed orientation.

2. A hinge in combination with pivotal rail components, the hinge being positioned between the rail components to hold such components in a horizontal aligned orientation when in the deployed orientation and in an essentially parallel orientation with respect to each other when in the collapsed orientation, the hinge including:

a saddle in a generally inverted U-shaped configuration with a central button aperture, interior plate apertures and exterior end apertures with associated rail pins for pivotally coupling the saddle and the adjacent interior ends of associated rail components;

a pair of normally vertically-oriented locking plates each with a plate pin coupling the upper end of each plate to a plate aperture of the saddle, each locking plate having an opening extending therethrough with a lower bearing surface and with springs urging the plates away from each other to a vertical orientation;

a liftable button with a vertically-oriented elongated slot through a central extent thereof and with an associated button pin for slidably coupling the button to the saddle, the button having upper exterior edges with inclined bearing surfaces; and an inwardly facing projection located at the adjacent interior edge of each adjacent rail component, each projection having an upper curved surface and a lower planar surface with a notch whereby the notches are receivable with the bearing surfaces of the plates when the rail components are in axial alignment.

3. A hinge positioned at the intermediate extents of the adjacent rail components to hold such components in an aligned orientation including:

a saddle with a central button aperture, interior plate apertures and exterior end apertures with associated rail pins for pivotally coupling the saddle and the adjacent interior ends of associated rail components;

a pair of locking plates each with a plate pin coupling the upper end of each plate to a plate aperture of the saddle, each plate having an opening extending therethrough the plates urged away from each other;

a liftable button with an elongated slot and with an associated button pin for slidably coupling the button to the saddle, the button having inclined bearing surfaces on their edges; and an inwardly facing projection located at the adjacent interior edge of each adjacent rail component, each projection having an upper curved surface and a lower planar surface receivable by the bearing opening.

4. The hinge as set forth in claim 3 and further including a notch formed in the lower planar surface of each projection adapted to be received on a lower bearing surface in the opening.

5. The hinge as set forth in claim 3 and further including a coil spring urging the plates toward each other and a vertical parallel orientation.

* * * * *